United States Patent [19]

Sajo et al.

[11] Patent Number: 4,462,432

[45] Date of Patent: Jul. 31, 1984

[54] HAND WEAVING MACHINE

[75] Inventors: Geza J. Sajo; Agnes Sajo, both of Toronto, Canada

[73] Assignee: Masterweaver (1982) Ltd., Toronto, Canada

[21] Appl. No.: 427,906

[22] Filed: Sep. 29, 1982

[51] Int. Cl.[3] ..... D03D 29/00

[52] U.S. Cl. ..... 139/33

[58] Field of Search ..... 139/29, 30, 31, 32, 139/33; 28/151, 152

[56] References Cited

U.S. PATENT DOCUMENTS

| | | | |
|---|---|---|---|
| 3,604,468 | 9/1971 | Sajo | 139/33 |
| 4,046,172 | 9/1977 | Russell | 139/33 |

FOREIGN PATENT DOCUMENTS

| | | | |
|---|---|---|---|
| 493207 | 5/1950 | Belgium | 139/33 |
| 685892 | 12/1939 | Fed. Rep. of Germany | 139/33 |
| 738311 | 10/1932 | France | 139/33 |
| 2344658 | 11/1977 | France | 139/33 |
| 513996 | 2/1955 | Italy | 139/33 |
| 1460531 | 1/1977 | United Kingdom | 139/33 |

*Primary Examiner*—Henry Jaudon

*Attorney, Agent, or Firm*—George A. Rolston

[57] ABSTRACT

A shedding device for a loom, having a plurality of thread separator discs, inner abutments on one side of each disc, outer abutments on a face of the disc, subtending a predetermined arc, on which a thread may be raised, a central opening through the disc, a spring extending into the opening, grooves on the disc for receiving the inner and outer abutments of the next disc, a plurality of openings formed through the disc and spokes defined by the openings at spaced apart locations.

12 Claims, 8 Drawing Figures

HAND WEAVING MACHINE

The invention relates to a shedding device for looms, and is of particular utility in the weaving of complex patterns.

Weaving in its simplest form simply involves the separation of some of the longitudinal warp threads from the remainder, and passing a shuttle containing the weft through the space between the raised warp threads and the remainder. Conventionally, this is carried out on a loom by means of so-called "heddles", in which individual warp threads are threaded through devices which can raise such warp threads mechanically. In order to achieve any kind of pattern in weaving, it is necessary to arrange such heddles in groups or "harnesses", which may be raised and lowered alternately, so as to move different groups of warp threads at different times, and thus achieve a pattern.

Where it is desired to weave a more complex pattern, however, warp threads may have to be raised in smaller groups or individually, in a predetermined sequence, and this can either be done painstakingly by hand, one at a time, or on a much more complex design of loom. Numerous different types of shedding devices have been proposed, by means of which complex patterns could be woven, but in the majority of cases, the designs have either involved an excessively complex construction, or alternatively, have been inconvenient to use. One greatly simplified form of shedding device is shown in U.S. Letters Pat. No. 3,604,468. It involved the use of individual warp separating discs mounted on a common shaft, which could be rotated as a single unit. The individual discs could be rotated on the shaft relative to one another, to vary the pattern. This enabled relatively complex weaving patterns to be achieved on a simple form of loom.

There were however certain practical short comings in the construction and design of such separator discs, and in particular, they did not provide for a sufficient degree of different positions which could be selected for the discs. They were difficult to manufacture in accordance with the necessary close tolerances required for the weaving of finer thread material. As a result, they were generally speaking most satisfactory only when used with relatively coarse, heavy gauge threads. In particular, while they were intended to be manufactured out of thermoplastic materials, it in fact proved to be difficult to manufacture them successfully from such materials, and they did not achieve their full potential.

BRIEF SUMMARY OF THE INVENTION

The invention seeks to overcome the disadvantages inherent in such shedding devices, and comprises a shedding device for use in a loom, for the separating of warp threads in such a loom, and comprising a plurality of thread separator discs, inner annular abutment means on one face of said disc, on which a said warp thread may lie when in its lower position, outer abutment means on the same face of said disc, subtending a predetermined arc, on which a said warp thread may lie when in its raised position, a central opening through said disc, spring biassed detent means partially extending into said opening, mating groove means on the reverse face of the disc, facing to the preceding disc for receiving its inner and outer annular abutment means, and wherein the improvement comprises a plurality of openings formed through said disc defining spaced apart arms extending between said inner annular abutment means and said outer abutment means.

More particularly, the invention comprises such a shedding device in which the outer annular abutment means is a thin arcuate rib, with discontinuities and end abutment portions at either end of said rib, whereby to define rounded ends.

More particularly, the invention comprises such a shedding device including raised lips along such rib to retain a filament thereon.

More particularly, the invention comprises the provision of such a disc having integral one-piece spring means formed of thermoplastic materials, fitting within said inner annular abutment means, and extending partially into said central opening.

The invention further comprises a shedding device having a plurality of such discs arranged side by side, a common shaft passing through the central opening of such discs, such shaft having flattened portions along its length, whereby to define, in cooperation with said detent means, a plurality of angular positions of each said disc relative to said shaft, said discs being rotatable around said shaft into said positions independently of one another, and including disc clamping means on said shaft, engageable with the endmost discs, for clamping such discs in a predetermined position, and rotational inducing means for causing partial rotation of said shaft, whereby to angularly displace all of said discs together in unison from one shedding position to the next consecutive shedding position, for shedding of warp threads carried thereon.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

Figure 8A:
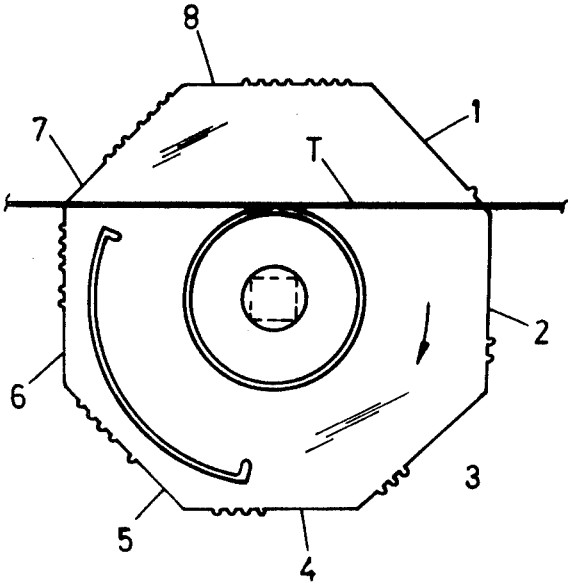
Figure 8B:
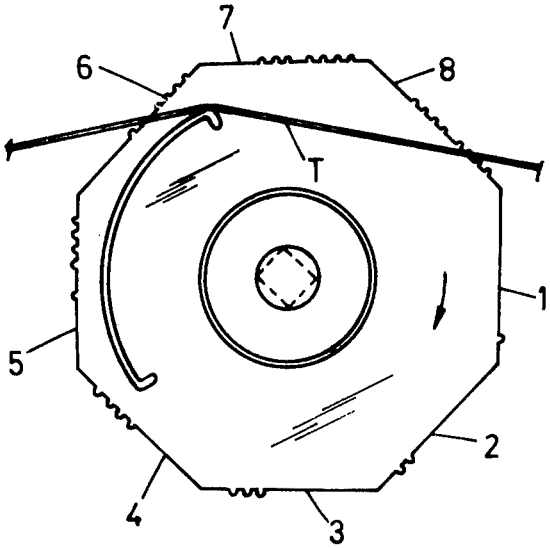

FIGS. 8*a* and 8*b* show the positions of the warps.

DESCRIPTION OF A SPECIFIC EMBODIMENT

Figure 1:
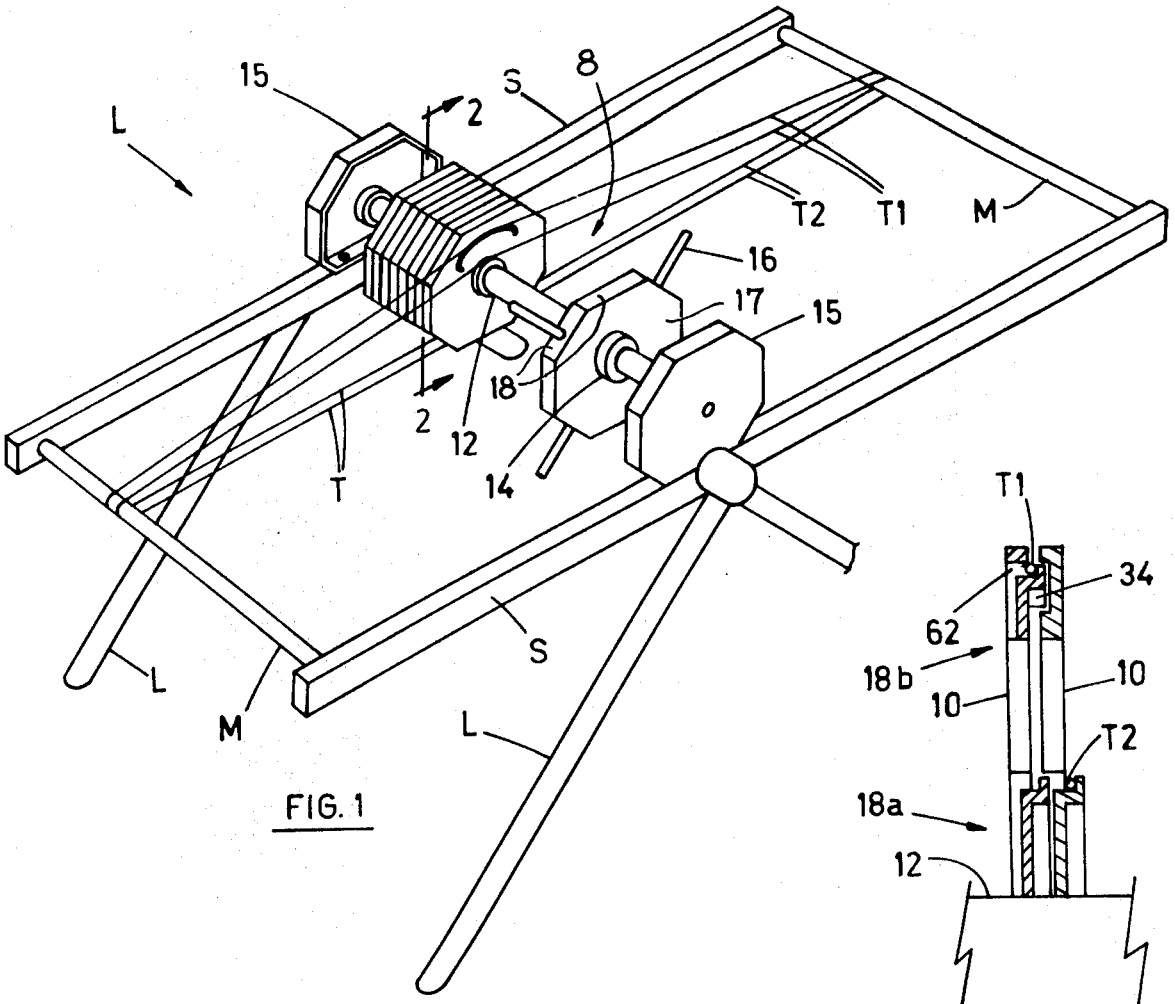
FIG. 1 is a perspective illustration of a hand loom incorporating a shedding device according to the invention showing a plurality of warp threads raised upwardly, and others lying in their downward position.

Referring now to FIG. 1, a loom L is shown having side frames F and end members M swingably mounted on a stand S. Warp threads T are shown tensioned around end members M.

The shedding device is shown generally as 8 and in accordance with the invention it comprises a plurality of individual separate disc members 10, arranged side by side on a common shaft 12. Clamping means such as the internally threaded rings 14 located on the shaft 12 at either end of the row of disc 10 are provided, which may be manually released and tightened up. The entire shaft, together with the discs 10 clamped thereon is supported between the bearings 15*a* on plates 15 mounted on side frames S. Shaft 12 and the entire set of discs 10 may be rotated by hand as a single unit by operation of the driving wheels 17 and handles 16 on either end of the shaft. Wheels 17 have eight flat surfaces 18 marked 1 to 8, indicating eight angular positions of shaft 12 and discs 10, 45° apart from one another. Only one such wheel 17 is shown for the sake of clarity.

Warp threads T are shown running between the individual discs 10. The thread T1 is shown raised upwardly, and the thread T2 is shown in its lower position. It will readily be understood that the weft thread, (not shown) carried on the usual shuttle (not shown) may be passed between the warp threads T1 and T2, forming a "shed".

Other features of a loom such as the batter or comb for packing the weft threads, warp tensioners and the like, are omitted for the sake of clarity.

Figure 2:
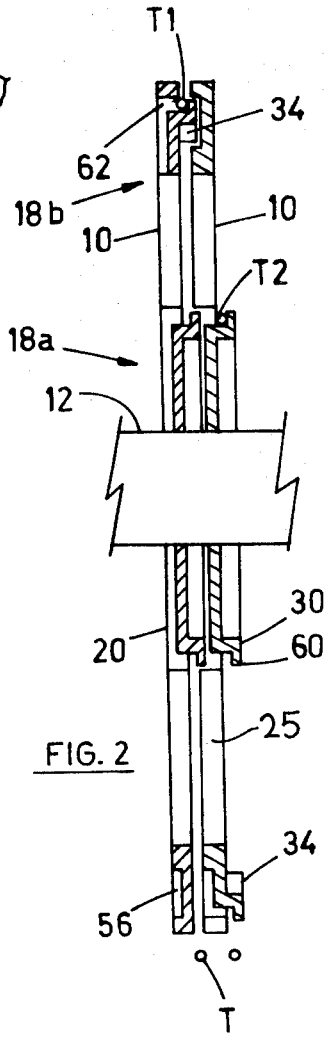
FIG. 2 is a section along the line 2—2 of FIG. 1, showing two such discs juxtaposed, and arranged on the shaft.
Figure 3:
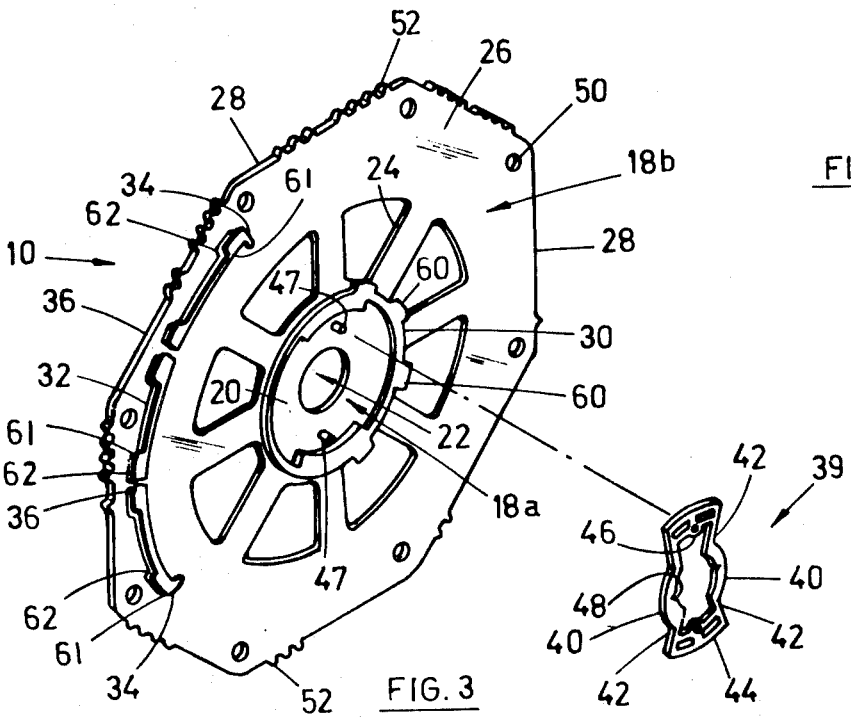
FIG. 3 is an exploded perspective of a disc.
Figure 4:
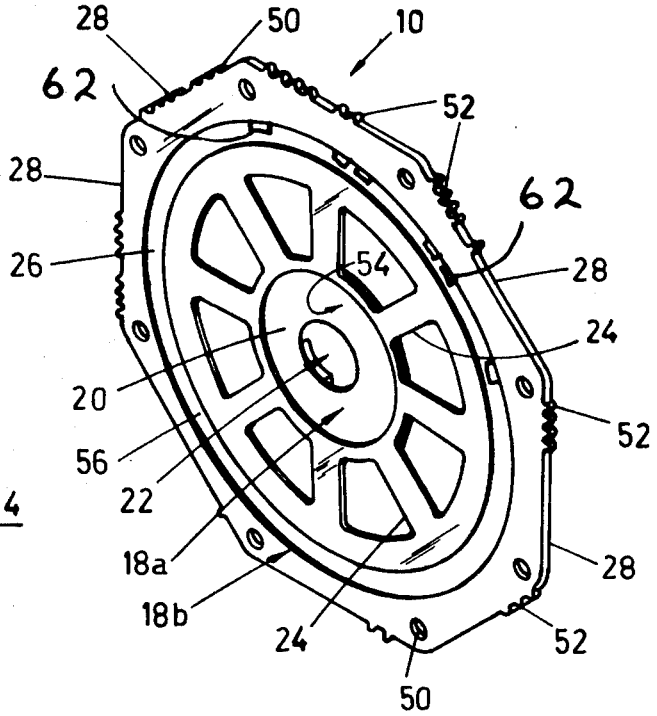
FIG. 4 is a perspective of the other face of the disc of FIG. 3.
Figure 5:
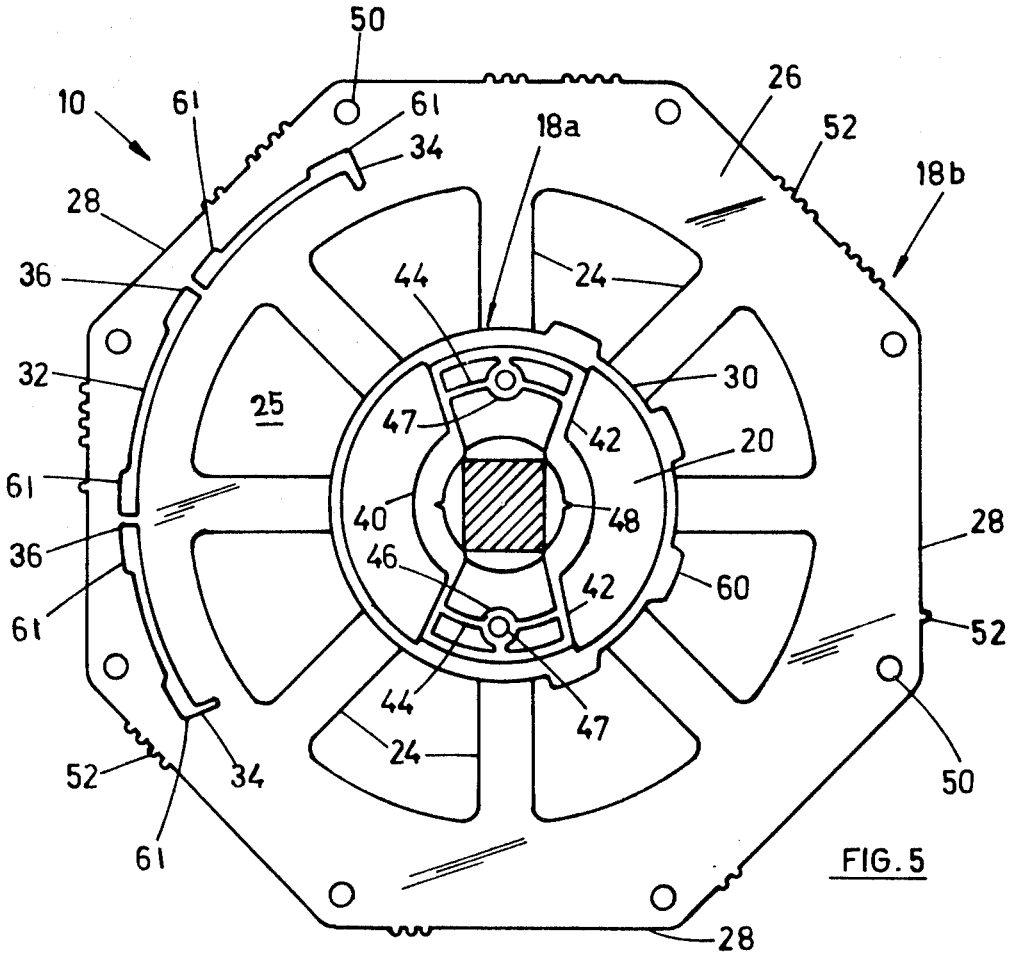
FIG. 5 is a side elevation of the disc of FIG. 3.
Figure 6:
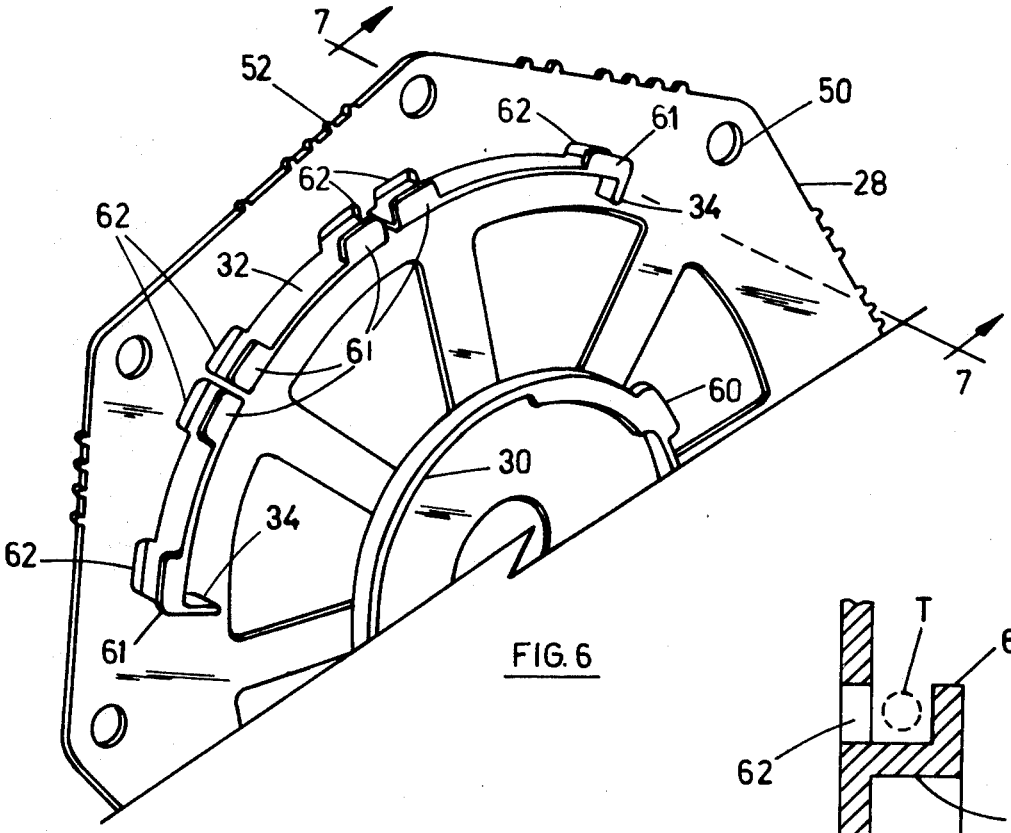
FIG. 6 is an enlarged perspective of a portion of the disc.
Figure 7:
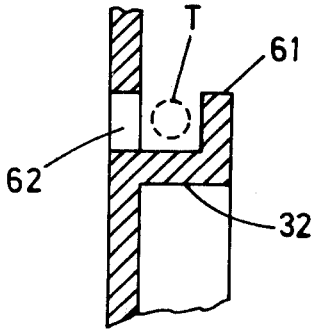
FIG. 7 is a section along 7—7 of FIG. 6.

The entire framework of frames F and ends M, can be rotated between bearings 19 on stand S. This permits warping by means of a single continuous warp thread. Such a thread can be tied to an end M and wound on by rotating the assembly. Each rotation, the thread is introduced between a pair of discs 10 (FIG. 2).

Referring now to FIGS. 2 to 8, it will be seen that each individual disc 10 comprises an inner central boss 20, having a central circular axial opening 22 therethrough. A plurality of arms 24 extend radially from boss 20 and define openings 25. An outer perimeter 26 connects with the arms 24. The perimeter portion 26 defines a plurality of linear edge surfaces, in this case eight such linear edge surfaces 28, forming an octagon shape.

Around the inner boss 20 on one face of disc 10 (FIGS. 3 and 5*a*) there is provided a raised annular abutment 30 in the form of a smooth rib, typically being formed integrally with such boss.

An outer abutment 32 is provided on the peripheral portion 26. Such outer abutment 32 subtends a predetermined angle, which may be understood with reference to FIGS. 9*a* and 9*b*. Outer abutment 32 in this case is of arcuate shape and commences and terminates at predetermined angular positions with relation to the linear edge portions 28 of the perimeter 26.

Both the inner annular abutment, and the outer abutment, are formed of relatively thin section material. The outer abutment is formed with end members 34 turned inwardly, and extending around a relatively large arc greater than the thickness of the material forming such abutment. A plurality, typically in this case two discontinuities or gaps 36 are provided in the outer abutment.

Spring biasing means 39 are provided within the inner annular abutment 30. In this case such spring biasing means is formed as an integral one-piece thermoplastic structure, comprising opposed semi-arcuate bearing portions 40, mounted at opposite ends on spring arms 42, which in turn extend outwardly and are connected by a pair of radially spaced apart semi-arcuate junction members 44. Bosses 46 are formed in junction members 44, and are provided with central openings. Suitable registering pins 47 are provided on the boss 20, fitting within such holes whereby to locate the spring biasing means. It will be noted that the bearing portions 40 extend partially into the central axial opening 22 of the boss 20, for bearing against portions of the shaft 12.

Typically, such bearing portions 40 will be formed with opposed angular registering recesses 48, and angular portions 13 are formed on shaft 12 for locating each disc 10 in an angular position on shaft 12. Typically, shaft 12 will be of square cross-section where it carries discs 10, and of round cross-section at either end, for mounting of clamp rings 14. However, it is apparent that other formations may be desirable for different shapes of shaft and for different purposes.

In order to rotate each individual disc 10, small circular openings 50 are formed in the outer perimeter, which may be engaged by any suitable form of tool, such as a wire hook or the like (not shown).

The rotational angular position of each disc on the shaft is indicated by means of raised positional indicia 52 formed on the flattened portions 28. In this way they are visible and may be identified visually, and may also be identified by touch in the case of handicapped persons.

On the reverse face of each such disc (FIG. 4) there is provided an inner annular recess 54, designed and dimensioned to receive within it a portion of the inner annular abutment 30. A further outer annular recess 56 is provided, designed to receive within it a portion of the outer abutment member 32. In this way, when the discs are arranged side by side on the shaft (FIG. 2), the abutment members fit and can rotate within their respective annular recesses, so that the individual warp threads are prevented from slipping off their respective abutments.

Preferably, the inner and outer abutments 30 and 32 may be provided with a plurality of retaining lips 60 and 61, located on the free edges of abutments 30 and 32 in spaced apart locations. Corresponding openings 62 are formed in the disc adjacent respective lips 61.

The lips 60 and 61 function to prevent the individual warp threads from slipping off their abutments 30 and 32. Preferably, some of the lips 61 on the outer abutments 32 are located at each end of each portion of the abutment for maximum control. On the inner abutments 30, such lips 60 are of course located in those regions where the thread will actually lie on such abutment.

In some cases it is possible for the threads to slip off the abutments 32. In this case they do not lift or separate to form a "shed" and errors result in the pattern. This is alleviated by the lips 60 and 61.

The nature of the warp lifting function, and the various positions at which this will occur in the rotation of each disc, is shown with reference to FIGS. 8*a* and 8*b*.

FIG. 8*a* shows a disc having a warp thread T. The thread T in FIG. 8*a* is shown in its lower position, resting on the inner annular abutment 30. The outer abutment 32 is shown at a position below the level of the thread T, so that the thread T is not displaced.

The numerical positions of the disc are shown being numbered 1 to 8 in a clockwise direction. Thus it is apparent that in four consecutive angular positions (in our drawings positions 8, 1, 2 and 3) the warp thread T will remain resting on the inner annular abutment 30 and will not be raised upwardly. Conversely, in the next four consecutive positions (in our drawing positions 4, 5, 6 and 7) it will be seen that the warp thread T will be raised upwardly.

In FIG. 8*b*, the disc is shown at position 7 with the warp thread T raised upwardly by the one end of the outer abutment 32.

From a study of the geometry of the device as illustrated, it will be apparent that the outer abutment 32 should subtend an arc or angle such that it produces a lifting of the warp T between any four adjacent positions on the disc. The warp thread T will remain in its lower position during the other four positions of the disc.

It will however be appreciated that if desired, different discs could be made in which lifting was achieved over five positions, and the warp thread T was left in its lower position in three positions, or the disc could be made so that it was providing lift in three positions and no lift in five positions.

A variety of different such configurations are possible.

It will also be appreciated that the length of the arc of the outer abutment 32 is dependent on the geometry of the disc, and the relative sizes of the inner abutment 30 and the outer abutment 32, and the radial distances between them. It should also be noted that in the particular case of the loom shown in FIG. 1, only the upper warp threads T have been considered.

In such a loom as illustrated, however, the warp thread is essentially a continuous thread which is wound around the two end members M end over end. The lower threads indicated in FIG. 1 as T will of course pass under adjacent disc, successively forming already the woven fabric running underneath the abutments. However, due to the geometry of the discs, and the size and location of the mounting flanges 15, the lower threads $T_1$ are not effected by rotation of the discs.

It will however be appreciated that the invention is not limited to the form of loom shown in FIG. 1, but is equally applicable to looms wherein separate warp threads are supported in a conventional type of loom structure with appropriate tensioners, and wind up and unwind devices, such as are used for weaving greater length of cloth.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A shedding device for use in a loom, for the separating of warp threads in such a loom, and comprising;

a plurality of thread separator discs having inner and outer portions;

inner annular abutment means on one side of said inner portion of each said disc on which a said warp thread may lie when in its lower position;

outer abutment means on a face of said outer portion of said disc, subtending a predetermined arc, on which a said warp thread may lie when in its raised position;

a central opening through said inner portion of said disc, through which adjacent discs can be arranged and switched individually in different consecutive angular positions on a horizontal shaft by aid of spring biased detent means partially extending into said opening;

groove means on said inner portion for receiving said inner annular abutment means of a next adjacent disc;

groove means on said outer portion for receiving said outer abutment means of an adjacent said disc;

a plurality of openings formed through said disc between said inner and said outer portions;

spoke means defined by said openings located at spaced apart locations and extending between said inner and outer portions, and, driving means on both ends of the said shaft for causing rotation of the shaft between two weft interlacings, whereby to angularly displace all of said discs together in unison, for shedding of warp threads carried thereon.

2. A shedding device as claimed in claim 1 wherein said outer abutment means comprises a generally arcuate shaped ridge portion extending outwardly from said outer portion of said disc, and subtending a predetermined angle, and including discontinuities formed in said ridge at spaced apart intervals.

3. A shedding device as claimed in claim 2 including ramp means formed at each end of said outer abutment means, for guiding a warp thread on to and off said outer abutment means.

4. A shedding device as claimed in claim 1 including lip means formed on said inner and said outer abutment means for retaining a warp thread thereon.

5. A shedding device as claimed in claim 4 wherein said groove means is dimensioned to receive a said abutment means together with its associated lip means.

6. A shedding device as claimed in claim 4 including opening means formed through said disc, in registration with said lip means, and having a dimension substantially equal to said lip means.

7. A shedding device as claimed in claim 4 wherein said lip means comprise a plurality of separate lip members spaced apart around said abutment means.

8. A shedding device as claimed in claim 1 including boss means formed on said inner portion of said disc, within the perimeter of said inner annular abutment means, and on opposite sides of said central opening, and including spring bearing means incorporated in said detent means, said bearing means abutting against said boss means.

9. A shedding device as claimed in claim 8 including register pin means on said inner portion of said disc, spaced on opposite sides of said central opening, and corresponding openings in said detent means.

10. A shedding device as claimed in claim 1, in which said detent means comprises a pair of generally arcuate shaped bodies, spring arm means connected at either end of said arcuate bodies, junction means connecting said spring arm means together, whereby said bodies may be moved apart against the force of said spring arm means, and notch means formed in said bodies.

11. A shedding device as claimed in claim 1, in which the said thread separator discs are formed in octagon shape having eight linear edge surfaces, and on their flattened portions having raised position indicia by means of which the angular position of each disc on the shaft can be visually identified.

12. A shedding device as claimed in claim 1, in which the driving means for causing rotation of the shaft between two consecutive weft interlacings have the same octagon shape as the discs, and their flattened sides are numbered 1–8 clockwise, indicating consecutive turning periods of the shaft, a full turn of the shaft being divided in eight turning periods, each of them describing an arc of 45°.

* * * * *